US005230118A

United States Patent [19]

Chamma

[11] Patent Number: 5,230,118

[45] Date of Patent: Jul. 27, 1993

[54] ORTHODONTIC TOOTH-BRUSH

[76] Inventor: Ayman Chamma, 34 Viger Street, Kirkland, Quebec, Canada, H9J 2E5

[21] Appl. No.: 794,129

[22] Filed: Nov. 12, 1991

[51] Int. Cl.[5] ..... A46B 9/04

[52] U.S. Cl. ..... 15/167.2; 15/167.1; 15/110

[58] Field of Search ..... 15/167.2, 167.1, 106, 15/110

[56] References Cited

U.S. PATENT DOCUMENTS

| | | | |
|---|---|---|---|
| 1,868,368 | 7/1932 | Reese | 15/167.1 |
| 2,244,615 | 6/1941 | Garcin | 15/167.2 |
| 4,053,959 | 10/1977 | Wiley | 15/167.1 |
| 4,382,309 | 5/1983 | Collis | 15/167.2 |
| 4,493,125 | 1/1985 | Collis | 15/167.2 |
| 4,706,322 | 11/1987 | Nicolas | 15/167.1 |
| 4,731,896 | 3/1988 | de la Tour | 15/167.1 |
| 5,027,463 | 7/1991 | Daub | 15/167.2 |

FOREIGN PATENT DOCUMENTS

| | | | |
|---|---|---|---|
| 21184 | 5/1936 | Australia | 15/167.2 |
| 2518845 | 11/1976 | Fed. Rep. of Germany | 15/167.2 |

*Primary Examiner*—Harvey C. Hornsby
*Assistant Examiner*—Patrick F. Brinson
*Attorney, Agent, or Firm*—Pierre Lespérance; Francois Martineau

[57] ABSTRACT

A toothbrush designed for use by orthodontic patients. The toothbrush head includes first conventional bristle tufts on one face, but further includes a lengthwise channel on the opposite face. The bottom face of this channel includes transverse second bristle tufts, and from the side faces of the channel depend interdigitating third bristle tufts, while third bristle tufts depend from the remainder of this face of the toothbrush head. Accordingly, the second and third bristles will be able to reach out small cavities about the braces worn by the patient's teeth, while the fourth bristles will clean tooth portions adjacent the braces. The teeth scrubbing action of the second, third and fourth bristles occurs concurrently in a single toothbrush stroke.

4 Claims, 4 Drawing Sheets

ORTHODONTIC TOOTH-BRUSH

FIELD OF THE INVENTION

The present invention relates to toothbrushes, and particularly to modified toothbrushes for use in thoroughly cleaning both the teeth and the braces interconnecting the teeth of an orthodontic patient.

BACKGROUND OF THE INVENTION

Dental patients wearing braces on their teeth have a difficult task when comes the time of thoroughly cleaning their teeth after each meal. Indeed, the brackets, wire and elastic bands constituting the braces create a plurality of small, difficult to reach cavities or channels where foodstuff particles may undesirably gather and come to clog same. Braces are worn on average for about two years, in view of mechanically correcting the relative arrangement of the teeth, according to standard orthodontic practice. Therefore, the accumulated foodstuff particles about the braces become a good breeding ground for bacteria resistant to the chemical agents of the saliva. Some of these bacteria may metabolically generate chemical by-products capable of attacking and structurally damaging the enamel of teeth, if they remain in constant contact therewith for a sufficiently long duration.

This of course is highly undesirable.

Conventional toothbrushes consist of an elongated tubular handle having at one end a "head" carrying a number of rows of nylon bristle tufts that transversely project from one face of the head. Such bristles are semi-flexible, in that they can—up to a certain point—clean various surfaces of the teeth when the latter are submitted to a scrubbing action with the toothbrush. However, because of the relatively substantial length of these bristles and of their orientation, they are only marginally effective for cleaning braces worn by the teeth. Therefore, some foodstuff particles will remain out of reach from the bristles of these prior art toothbrushes, and thus will remain stuck onto the braces, even after extended use of conventional toothbrushes, with possible damaging effect on the nearby teeth.

OBJECTS OF THE INVENTION

The gist of the invention is therefore to specifically address the hygienic needs of dental patients wearing braces on their teeth.

A corollary object of the invention is to provide a toothbrush specifically designed to thoroughly clean all parts of orthodontic patient teeth including the brackets anchored on the labial face, or alternately on the lingual face of the teeth.

An important object of the invention is to provide a toothbrush as detailed above, which can clean various cavities of the braces and the teeth labial surfaces, in a concurrent fashion in a single lengthwise stroke of the toothbrush.

A general object of the invention is to provide such an above-noted toothbrush, which will be of simple handling and of very low manufacturing cost, so as to be usable by any dental patient, yet being of very high efficiency.

SUMMARY OF THE INVENTION

Accordingly with the teachings of the invention, there is disclosed an orthodontic toothbrush for use in scrubbing teeth bearing brackets on their labial or lingual faces; each said bracket of the type having a main body defining a smooth face, anchored to a corresponding tooth, a grooved brace wire receiving face, opposite said first face, two opposite side edges joining said first and second faces generally transversely to the tooth, and two grooves made in said side edges and adapted to receive a brace wire securing elastic band; said toothbrush defining an elongated handle and a head integral to a portion of the handle; wherein said head comprises a longitudinal central channel made in one of its two opposite main faces and bristles protruding from the bottom and side faces of this channel for scrubbing the grooved faces of the brackets and for scrubbing within both said bracket grooves. Said head further includes additional bristles on each side of said central channel for scrubbing the teeth surfaces around the brackets.

DETAILED DESCRIPTION OF THE INVENTION

Figure 1:
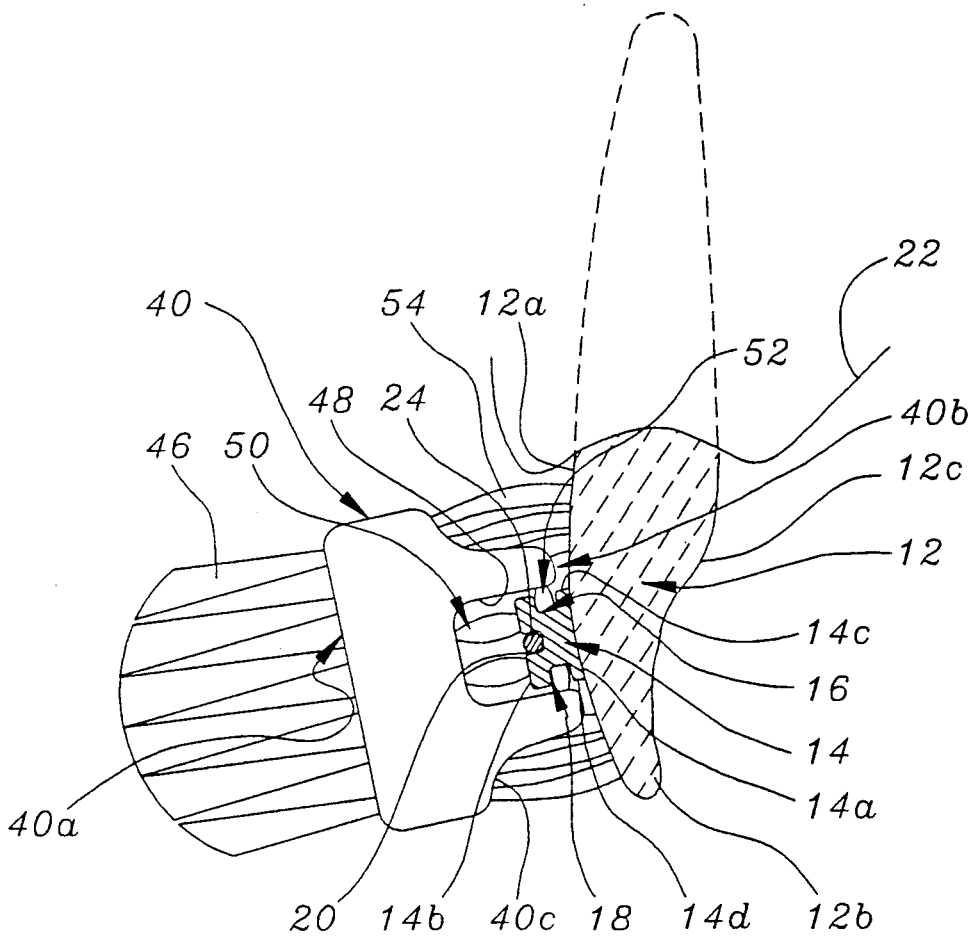
FIG. 1 is a cross-section of a toothbrush head of the invention, shown in operative scrubbing position onto the orthodontic brace of one patient's tooth.
Figure 2:
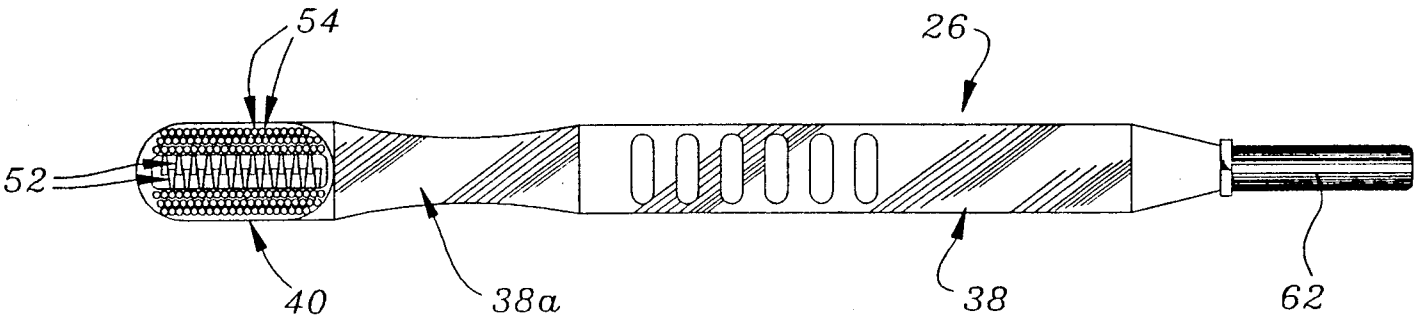
FIG. 2 is a top plan view of the preferred embodiment of toothbrush, at a reduced scale relative to FIG. 1.
Figure 3:
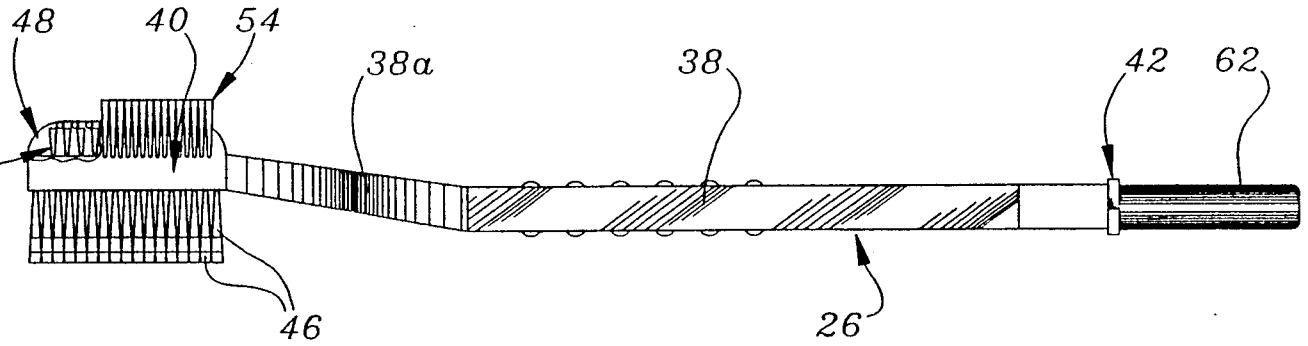
FIG. 3 is a side edge view of the toothbrush, with its head partly broken to show the brace scrubbing bristles.
Figure 4:
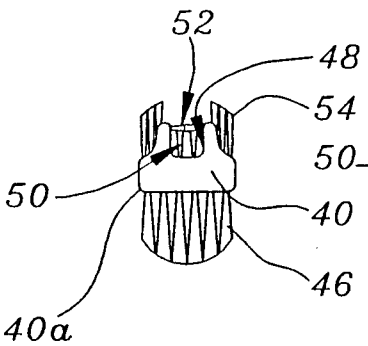
FIG. 4 is an end view of the toothbrush head.
Figure 6:
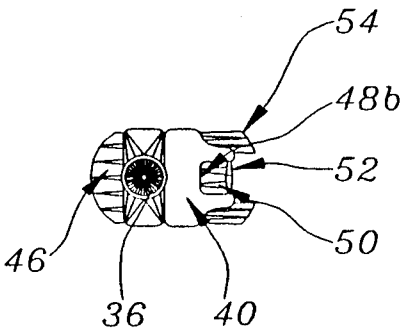
FIG. 6 is an end view of the toothbrush opposite that of FIG. 4.
Figure 5:
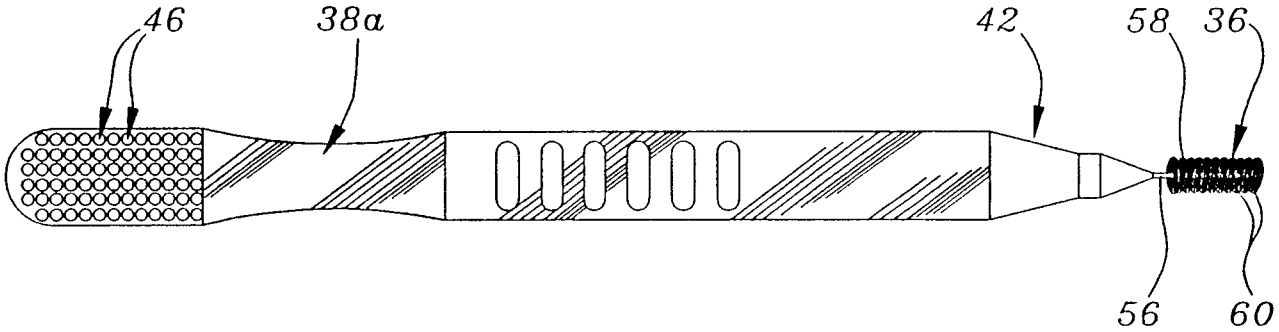
FIG. 5 is a bottom plan view of the toothbrush.

Tooth 12 represented in FIG. 1 is part of the braced teeth of a dental patient. Accordingly with standard orthodontic dental treatment, each tooth 12 is provided on its labial (exterior) surface 12*a* with a bracket 14. Bracket 14 is generally H-shape in cross-section, and is glued to the tooth 12 by a conventional, strong, resin-based glue. H-shape bracket 14 thus defines two opposite, large faces 14*a*, 14*b* and two opposite short side faces 14*c*, 14*d* having wide U-shape channels 16, 18, respectively. Moreover, the exterior free wall 14*b* of bracket 14 further includes a narrow U-shape channel 20, intermediate U-channels 16 and 18. Channels 16–18 are coplanar to one another, and channel 20 is parallel to channels 16–18. It is the bracket interior face 14*a* which is flatly anchored by gluing to an intermediate section of the tooth labial surface 12*a*, approximately halfway between the crown 22 and the free end tip 12*b* of that tooth 12. A metallic wire 24 extends lengthwisely through the narrow U-channel 20 of each bracket 14, and may be tensioned in a carefully monitored fashion and lockingly maintained as such by known tensioning means (not shown).

Braces 14, 24 are worn for a few years, in view of forcibly and mechanically exerting biasing forces applied to the teeth so as to induce relative movements of the teeth to correct irregularities or abnormalities of the teeth arrangement.

Each tooth bracket 14 is conventionally engaged by a corresponding elastic band (not illustrated), engaging U-channels 16, 18, and overlapping successive sections of the wire 24, so as to maintain the latter embedded into the various narrow U-channels 20. Alternately, special metallic ligatures (not shown) may be used to replace the elastic bands in interconnecting the brackets.

After the orthodontic treatment is completed, the brackets are removed by a wedging force through use of special pliers having sharp bevelled jaws. These pliers jaws are capable of engaging transversely in between the bracket interior wall 14*a* and the tooth labial surface 12*a*, so as to cut out the cured resin therebetween. The brackets can then be released.

It is at that time that the enamel degrading action of accumulated bacteria become clearly apparent, since the brackets have continuously concealed the portion of tooth labial wall previously anchored to the bracket.

The toothbrush of the invention is referenced as 26 and consists of an elongated, rigid, substantially straight body 38 defining first and second opposite end sections 40, 42. Body 38 is usually made from a cheap, lightweight, plastic material of rectangular cross-section. End section 40 forms a head, with a main flat face 40*a* poked with a plurality of cavities each receiving and retaining a tuft of conventional, elongated nylon bristles 46. Head 40 is thicker than body 38, defining a main face 40*b* opposite flat face 40*a*. The adjacent portion of body 38 is also slightly bent at 38*a*, whereby head 40 becomes offset outwardly from the general plane of body 38.

Accordingly with the invention, an elongated, channel 48, e.g. of a cross-sectionally U-shape, is made centrally and lengthwisely of the toothbrush head in main face 40*b*. Channel 48 is freely opened at both ends 48*a*, 48*b*, and the bottom 48*c* of U, channel 48 lies in a plane which clears handle body 38. Bottom 48*c* and side faces 48*d* of channel 48 are parallel and normal to head main face 40*a* respectively.

Toothbrush channel 48 must be wider and deeper than the width and thickness respectively of bracket 14, so that the latter be freely engageable thereinto, as suggested in FIG. 1. Channel 48 is narrower than head 40 which defines concave face portion 40*c* on each side of groove 48.

Figure 7:
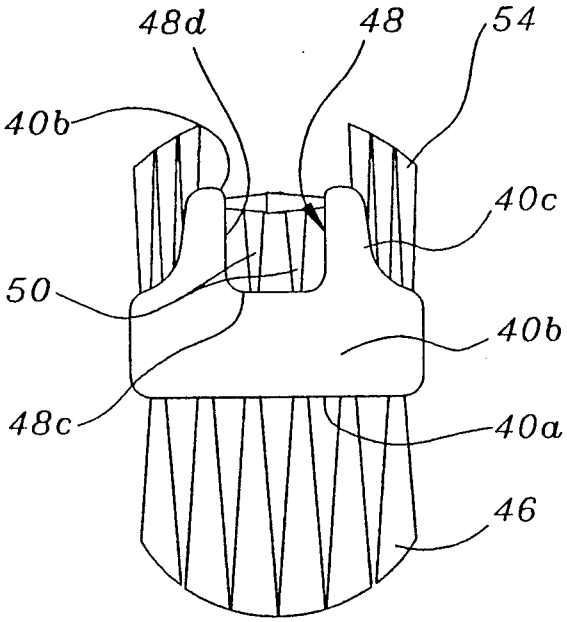
FIG. 7 is a view similar to FIG. 4, but at an enlarged scale and disclosing an alternate embodiment of toothbrush with the peripheral non-channel bristles of its head being removed.

From the bottom 48*c* of U-channel 48 project tufts of bristles 50, embedded into head 40 and parallel to the oppositely directed bristles 46. Bristles tufts 50 are arranged in a few lengthwise rows, as suggested in FIG. 7, and extend slightly short of the top (transverse) mouth 48*f* of U-channel 48, spacedly from side faces 48*d* thereof. Bristles 50 should therefore and accordingly be substantially shorter than bristles 46.

Figure 8:
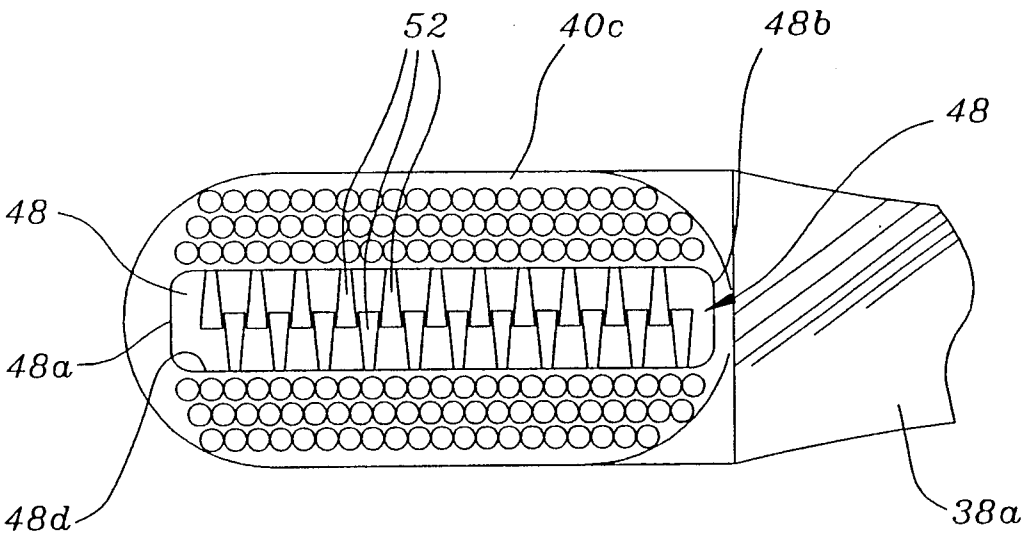
FIG. 8 is an enlarged view of the left portion of FIG. 2, illustrating the interdigitating set of bristles within the toothbrush head.

Additionally, from the side face 48*d* of channel 48, just below the plane of the head face 40*b* and parallel to channel bottom 48*c* project two opposite rows of short bristles tufts 52, embedded into head 40 and forming an interdigitating arrangement best illustrated in FIG. 8. The free ends of the bristle tufts dependent from one channel side face overlap the free ends of the bristle tufts dependent from the other channel side face.

The free ends of the opposite bristles tufts 52 may extend short of each other, in the latter case, a central gap extends between the bristles 52 of the two opposite rows.

Interdigitating bristle tufts 52 transversely clear the tips of bristles 50 which terminate just short of bristles 52.

Bristles 50, 52 are made of strands of a semi-flexible material, capable of efficiently scrubbing stainless steel surfaces; nylon is one such material, for example. Additional short bristle tufts 54 are embedded into the concave surface 40*c* of the toothbrush head 40, exteriorly of channel 48 and projecting parallel to bristles 50 in the same general direction and beyond head face 40*b*. Preferably, bristles 54 are of increasing length as their position is farther from channel 48.

It can now be understood how toothbrush 26 is to be

Bristles 46 are used in the usual way to clean the tooth surfaces which are devoid of brackets 14. By causing channel 48 to receive the brackets 14 and by a lengthwise back and forth toothbrush displacement axially of channel 48, bristles 50 will scrub the faces 14*b* of a few successive brackets 14, intergigating bristles 52 will enter and clean the side grooves 16 and 18 of successive brackets 14 and bristles 54 will engage and scrub the labial surfaces 12*a* between the brackets 14 and the crowns 22, and between the brackets 14 and the tips 12*b* of the teeth.

The end section 42 of toothbrush 38 opposite head 40 is conical, defining a minute outer end tip 56. A strong, semi-rigid, bristle strand member 58 projects from the end tip 56 coaxially with elongated handle 38. Bristle strand member 58 includes a plurality of radially extending, flexibly mounted, discoid pads 60, closely spaced from one another. The length of bristle strand member 58 is approximately that of the long bristles 46 of the head 40, the diameter of strand proper 58 is substantially smaller than the diameter of each tuft of strand 46 of the toothbrush head, while the diameter of discoid pads 60 is approximately that of each tuft of bristles 46 of head 40. When not in use, bristle strand member 58 is shielded by a protective cylindrical cap 62, with its mouth frictionally locking onto the conical seat 42.

Bristle member 58 is used to clean hard to reach areas, especially those areas close to the gum line, as well as about the sides of each tooth. Bristle member 58 will also reach out under the orthodontic wire. Flexible discoid pads 60 are particularly efficient in reaching out for small foodstuff particles, which may gather in difficult to reach cavities.

The brackets 14 and the wire 24 are conventionally made from stainless steel, a hardened plastic material, ceramic-based material, or an alloy made from a combination of two or more of the above-noted materials.

Each tuft of elongated bristles 46 is preferably of constant length relative to the other tufts 46; each tuft of short bristles 50, also of constant length relative to the other tufts 50; and each tuft of short bristles 52, again is preferably of substantially constant length with respect to the other short tufts 52. On the other hand, peripheral bristles 54 could be of varying length, i.e. shorter near channel 48 and progressively longer as one moves away from channel 48, so as to remain fully effective in reaching the free labial wall surface of the braced tooth.

Although the braces are most commonly and preferably used on the labial surfaces of the teeth, as they were hereinabove described, they are sometimes alternately applied by dentists onto the tooth lingual surface (the tooth surface opposite the labial surface). It should be understood that the present toothbrush would be fully effective in efficiently scrubbing the tooth and all parts of the bracket for a tooth provided with a lingual surface mounted bracket.

I claim:

1. An orthodontic toothbrush for use in scrubbing teeth fitted with a brace on their labial or lingual surfaces, said brace of the type including a series of brackets fixed to successive teeth and a brace wire interconnecting the brackets, each bracket having a first surface anchored to a corresponding tooth, a second surface opposite said first surface and having a brace wire receiving groove, two opposite side edges each having a groove to receive a brace wire securing elastic band, said toothbrush defining an elongated handle and a head at one end of said handle, said head defining opposite ends and opposite first and second head faces, said first head face having a longitudinally extending channel fully opening at both ends of said head and defining a bottom face and side faces parallel to and normal to said second head face respectively, said channel being narrower than the width of said first head face and extending centrally of the latter; said first head face defining two face portions, one on each side of said channel; first and second tufts of bristles protruding from and perpendicular to said bottom and side faces of said channel, respectively, for scrubbing said second surface of said brackets and the grooved side edges of said brackets, respectively, and third tufts of bristles protruding from said face portions on each side of said channel, generally parallel to and extending in the same direction as said first tufts of bristles and terminating beyond said first head face for scrubbing the tooth surfaces around said brackets.

2. An orthodontic toothbrush as defined in claim 1, wherein said second second tufts of bristles are disposed in two opposite rows, one row on each of the two side faces of said channel, the bristles of one row interdigitating with the bristles of the other row.

3. An orthodontic toothbrush as defined in claim 2, wherein the bristles of the first tuft of bristles terminate close to the bristles of the second tufts of bristles.

4. An orthodontic toothbrush as defined in claim 3, further including fourth tufts of bristles protruding from substantially the entire surface of said second head face for scrubbing the tooth surfaces which are devoid of said brackets.

* * * * *